US010479100B2

(12) United States Patent
Bolumar et al.

(10) Patent No.: US 10,479,100 B2
(45) Date of Patent: Nov. 19, 2019

(54) PRINTER WITH AN AIR PRESSURIZATION SYSTEM AND METHOD OF BUILDING UP AIR PRESSURE IN A PRINTING FLUID SUPPLIER

(71) Applicant: Hewlett-Packard Development Company, L.P., Houston, TX (US)

(72) Inventors: Gemma Bolumar, Barcelona (ES); Joan Sanjuan, Barcelona (ES); Oriol Parera Fiestas, Barcelona (ES); Jose Ignacio Palacios Higueras, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/569,891

(22) PCT Filed: Jul. 31, 2015

(86) PCT No.: PCT/EP2015/001589
§ 371 (c)(1),
(2) Date: Oct. 27, 2017

(87) PCT Pub. No.: WO2017/020918
PCT Pub. Date: Feb. 9, 2017

(65) Prior Publication Data
US 2018/0117922 A1 May 3, 2018

(51) Int. Cl.
*B41J 29/38* (2006.01)
*B41J 2/175* (2006.01)

(52) U.S. Cl.
CPC ..... *B41J 2/17556* (2013.01); *B41J 2/175* (2013.01); *B41J 2/17596* (2013.01); *B41J 2/17523* (2013.01)

(58) Field of Classification Search
USPC ..... 347/6
See application file for complete search history.

(56) References Cited

U.S. PATENT DOCUMENTS 5,451,987 A 9/1995 Perrin
6,302,516 B1 10/2001 Brooks et al.
(Continued)

FOREIGN PATENT DOCUMENTS

CN 103016115 4/2013
EP 0588698 3/1994

OTHER PUBLICATIONS

Schmidt, M.A. et al., "MIT-OSU-HP Focus Center on Non-lithographic Technologies for MEMS and NEMS" Actuators & Power MEMS, 2007, 10 pages.

*Primary Examiner* — Lam S Nguyen
(74) *Attorney, Agent, or Firm* — HP Inc. Patent Department

(57) ABSTRACT

A printer comprising a printing fluid circuit having at least one printing fluid supplier, an air pressurization system to build up air pressure inside the at least one printing fluid supplier, and a controller is provided, wherein the air pressurization system is fluidly connected to the at least one printing fluid supplier. The controller is to determine the air pressure which has been built up in the at least one printing fluid supplier by the air pressurization system, and to determine a degradation of the air pressurization system depending on the air pressure which has been built up in the at least one printing fluid supplier by the air pressurization system.

19 Claims, 6 Drawing Sheets

(56) References Cited

U.S. PATENT DOCUMENTS

| | | | | |
|---|---|---|---|---|
| 8,529,038 | B2 | 9/2013 | Leighton et al. | |
| 2001/0010531 | A1 | 8/2001 | Hsieh et al. | |
| 2006/0192822 | A1 | 8/2006 | Usuda | |
| 2010/0220127 | A1* | 9/2010 | Levy | B41J 2/175 347/6 |
| 2011/0317204 | A1 | 12/2011 | Tanner et al. | |
| 2014/0022318 | A1 | 1/2014 | Cameno et al. | |
| 2015/0062259 | A1 | 3/2015 | Yamada | |

* cited by examiner

PRINTER WITH AN AIR PRESSURIZATION SYSTEM AND METHOD OF BUILDING UP AIR PRESSURE IN A PRINTING FLUID SUPPLIER

BACKGROUND

The description refers to a printer with an air pressurization system and to a method of building up air pressure in a printing fluid supplier. Printers, such as inkjet printers, with an air pressurization system, for example air pumps, are pressurized to reach a working air pressure. For example, in an inkjet printer the air pumps build up a working air pressure inside a common volume of a plurality of printing fluid suppliers to make the printing fluid flow from the printing fluid suppliers to the print heads. With ongoing use, the air pumps degrade, for example as a result of the fatigue of the material. This degradation leads to problems with the printer. Among these problems are, for example, job cancellation resulting in a waste of paper and printing fluid, functionality reduction, e.g. the continuous printing fluid delivery function, which switches to another printing fluid supplier when the currently used one runs out of printing fluid, could be disabled if it is impossible to recover the working air pressure during a cartridge swap, or the failure of the print heads (starvation failure) if they run out of printing fluid as a consequence of the lack of pressure on the printing fluid suppliers. To avoid these printing problems, some commercially available printers depressurize the system and automatically cancel the job when the pressure decreases below a lower limit. That is, the printer acts automatically in order to protect the components and the user has no other option but to reboot the printer. When these interruptions become more frequent, the user has to replace components. For some commercially available printers this means that the user has to contact support to get the system repaired with the inconveniences associated of having the printer turned off during this time.

BRIEF DESCRIPTION OF THE DRAWINGS

The present disclosure refers to the accompanying drawings, in which corresponding reference numerals indicate corresponding parts and in which.

DETAILED DESCRIPTION

Figure 1:
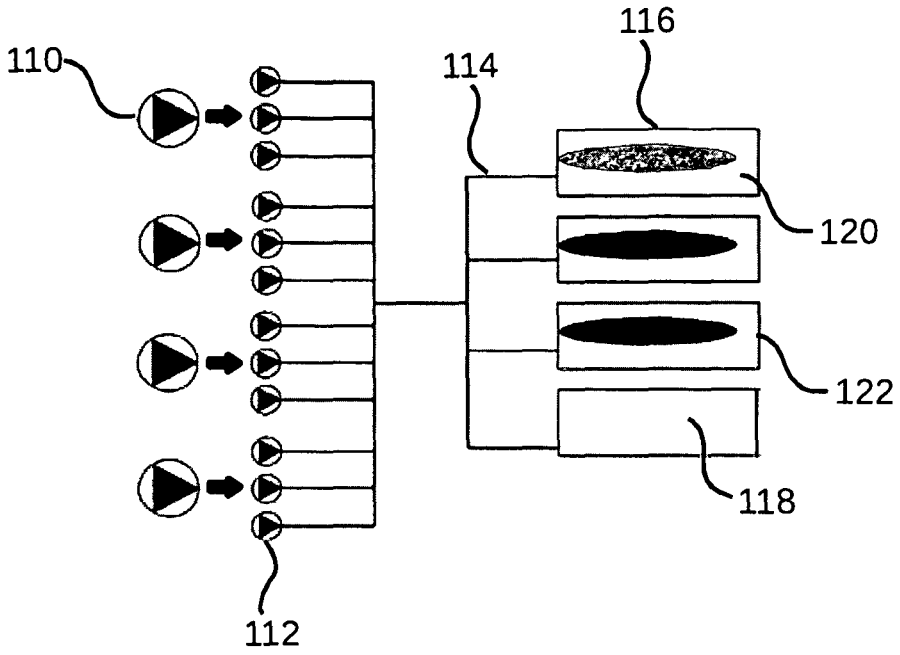
FIG. 1 is a schematic representation of the printer according to one example.

Various aspects will be described below by referring to the figures. Features with similar properties or functions, which are shown in multiple figures, are referred to by the same reference numerals and will be explained upon their first mention. However, before proceeding further with a detailed description of the figures, further aspects are discussed.

FIG. 1 is a schematic representation of an exemplary printer, for example an inkjet printer. The printer comprises four printing fluid suppliers 116, e.g. cartridges, each having a printing fluid reservoir 118 for storing the printing fluid and a print head 122 fluidly connected thereto. The cartridges, the print heads 122 and their fluid connection constitute a printing fluid circuit with the print heads 122 acting as its endings. In some examples, the number of printing fluid suppliers 116 is different, such as one, two, three or more than four. In some examples, the printing fluid suppliers 116 comprise more than one printing fluid reservoir 118 each, for example two, three or more than three. In some examples, the print heads 122 are fluidly connected to the printing fluid reservoirs 118 by a tubing system. In some examples, the print heads 122 are an integral part of the printing fluid suppliers. In some examples, the print heads 122 are located remotely from the printing fluid suppliers. For example, the print heads 122 may be disposed at the printer, apart from the printing fluid suppliers.

Each cartridge 116 further contains an initial volume of air 120 surrounding the printing fluid reservoir. The cartridges 116, in particular the volumes of air inside the cartridges, are fluidly connected by a common tubing system, such that a common volume of air 120 is formed. In some examples, the cartridges 116 may not be connected among each other, such that each volume of air 120 inside a cartridge 116 is fluidly separated from the others. In some examples, each printing fluid supplier 116 has approximately the same initial volume of air 120 inside. In other examples, the initial volume of air 120 inside each printing fluid supplier 116 may be different. The printing fluid reservoirs 118 are made of a material that can transmit the surrounding air pressure to the ink, for example an elastic or flexible material, such as a plastic material.

The printer further comprises an air pressurization system to pressurize the volume of air 120 inside the cartridges. The air pressurization system comprises four air pumps 110 which are fluidly connected to the cartridges 116 by the common tubing system. The air pressurization system and the tubing system constitute a pneumatic circuit which fluidly connects the air pressurization system and the printing fluid suppliers. Each air pump 110 comprises three pistons, therefore the air pressurization system has a total of twelve pistons 112 that work in parallel. In some examples, the number of air pumps 110 is different, such as one, two, three or more than four. In some examples, the number of pistons 112 per air pump 110 is different, such as one, two, or more than three. In some examples, the common volume of air 120 inside the printing fluid suppliers 116 is pressurized by the air pressurization system. In other examples, the volume of air 120 inside each printing fluid supplier 116 is pressurized separately by the air pressurization system.

In order to make the printing fluid flow from the reservoir 118 to its corresponding print head 122 via the fluid connection therebetween the surrounding volume of air 120 is pressurized to a working air pressure by the air pressurization system. When the working air pressure is reached, printing fluid flows from the printing fluid reservoir 118 to the print head.

In some examples, the volume of air 120 inside the cartridges 116 is kept at ambient pressure while not printing. In some examples, the air pressurization system may be used to keep the volume of air 120 inside the cartridges 116 at low pressure to prevent the ink from flowing while not printing. As printing fluid is consumed, the volume of air 120 inside the cartridges 116 increases. Thus, the volume of air 120 to be pressurized increases with increasing consumption of printing fluid of each cartridge. In some examples, each active printing fluid supplier 116 has a different consumption of printing fluid, resulting in different volumes of air inside the different active printing fluid suppliers.

In some examples, the air pumps 110 are redundant, i.e. the air pressurization system can still pressurize the volume of air 120 inside the cartridges 116 to working air pressure if one or some of the air pumps 110 have failed. For example, the air pressurization system may comprise a plurality of air pumps 110 which are fluidly connected to a common volume of air 120 inside the printing fluid suppliers. In some examples, the pistons 112 of each air pump 110 are redundant, i.e. each air pump 110 may still be able to build up air pressure if one or some of its pistons 112 have failed.

The most common failure mode of these air pumps 110 is the failure of the piston's membrane as a result of the fatigue of the material, e.g. rubber. The breakage of the membrane makes the piston 112 inoperative, reducing the efficiency of the air pump 110 down to zero once all three pistons 112 have failed.

However, when some or all of these pistons 112 are sane, they propel air inside the printing fluid suppliers 116 until working air pressure is reached. Since the three pistons 112 of each air pump 110 are redundant, each air pump 110 can still build up air pressure if one or two of its pistons 112 have failed. The four air pumps 110 itself are also redundant, since they are all fluidly connected to a common volume of air 120 to be pressurized.

The printer further comprises a controller (not shown). The controller is to determine the air pressure which has been built up in the cartridges 116 by the air pressurization system. The controller is further to determine a degradation of the air pressurization system depending on the air pressure which has been built up in the cartridges 116 by the air pressurization system. In some examples, the controller is a printer-integrated processor, an expansion card or a stand-alone device. In some examples, the controller comprises or is connected to a memory with computer-readable instructions stored therein which, when executed, cause the printer to determine the air pressure which has been built up in the cartridges 116 and to determine a degradation of the air pressurization system depending on that air pressure. In some examples, the controller may consist of such computer-readable instructions stored in a memory apart from the controller.

Figure 6:
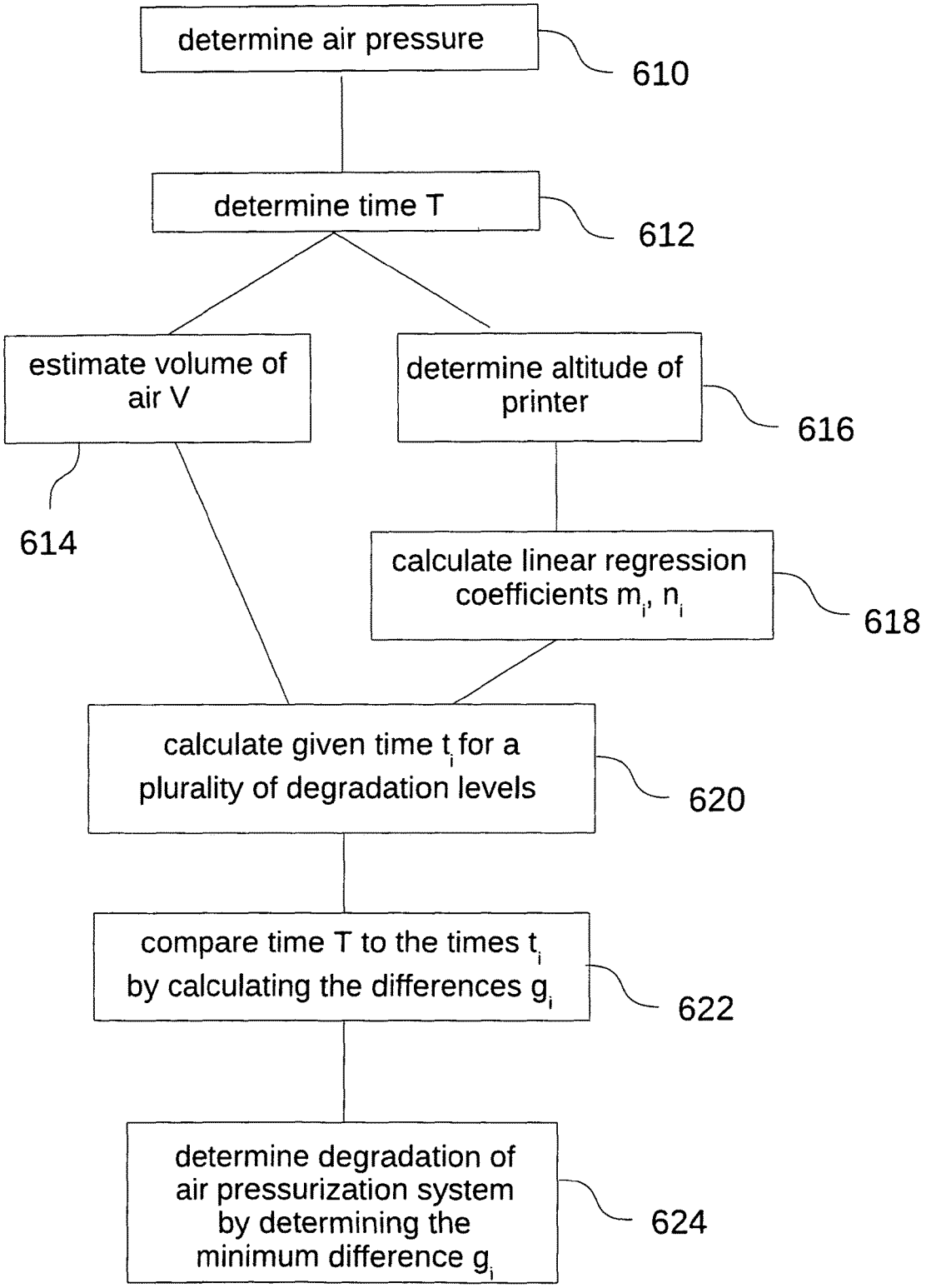
FIG. 6 is a flow diagram of a method of determining the degradation of the air pressurization system, according to an example.

An example method of determining the degradation of the air pressurization system is based on the time needed to reach a given air pressure, e.g. the working air pressure, inside the common volume of air. The result of this method is a measure that indicates the degradation of the air pressurization system. A flow chart of one example of such a method is shown in FIG. 6.

The degradation of the air pressurization system is indicated by a discrete value, the degradation level. In some examples, the degradation level may be an integral number. In particular, the degradation level may be a positive integral number. In some examples, the degradation level may be a fraction or a percentage.

For example, the degradation level corresponds to the number of working pistons 112 in the air pumps 110 of the air pressurization system. In some examples, the degradation level may correspond to the number of failed pistons 112 instead. In some examples, the degradation may be indicated by a value, e.g. by a percentage, which corresponds to the efficiency of the air pressurization system. In some examples, the degradation may be indicated by a mark or a score which corresponds to the condition in which the air pressurization system is. For example, the air pressurization system may be in "good", "medium" or "poor" condition.

The air pressure which has been built up by the air pressurization system in the common volume of air 120 inside the four cartridges 116 is determined by the controller of the printer (step 610). Furthermore, the time T needed to build up that air pressure is also determined by the controller of the printer (step 612). In some examples, the controller is connected to a pressure sensor to determine the air pressure in the common volume of air. In some examples, the pressure may be determined by the electrical power that is drawn by the air pumps 110.

In some examples, the pressure sensor may be a manometer. In some examples, the pressure sensor may be an electronic pressure sensor. Electronic pressure sensors may be, e.g., capacitive pressure sensors in which a capacitance varies depending on the surrounding air pressure or an electromagnetic pressure sensor in which, for example, an inductance varies depending on the surrounding air pressure. In some examples, the pressure sensor may be a resonant pressure sensor which utilizes changes in the resonant frequency in a sensing mechanism with varying air pressure or a thermal pressure sensor which utilizes changes in the thermal conductivity, e.g. of a gas, with varying air pressure.

In some examples, the air pressure which has been built up may be determined at a first time and at a second time. The air pressures determined at the first time and at the second time may be different.

In some examples, the controller comprises an internal clock to measure the time T which has been used to build up the given air pressure in the common volume of air 120 inside the four cartridges. In some examples, the given air pressure is the working air pressure. In some examples, the given air pressure, e.g. the working air pressure, has been previously stored, for example, in the memory which the controller comprises or to which the controller is connected. In some examples, the working air pressure is determined as being approximately the maximum air pressure which can be built up in the common volume of air.

Figure 3:
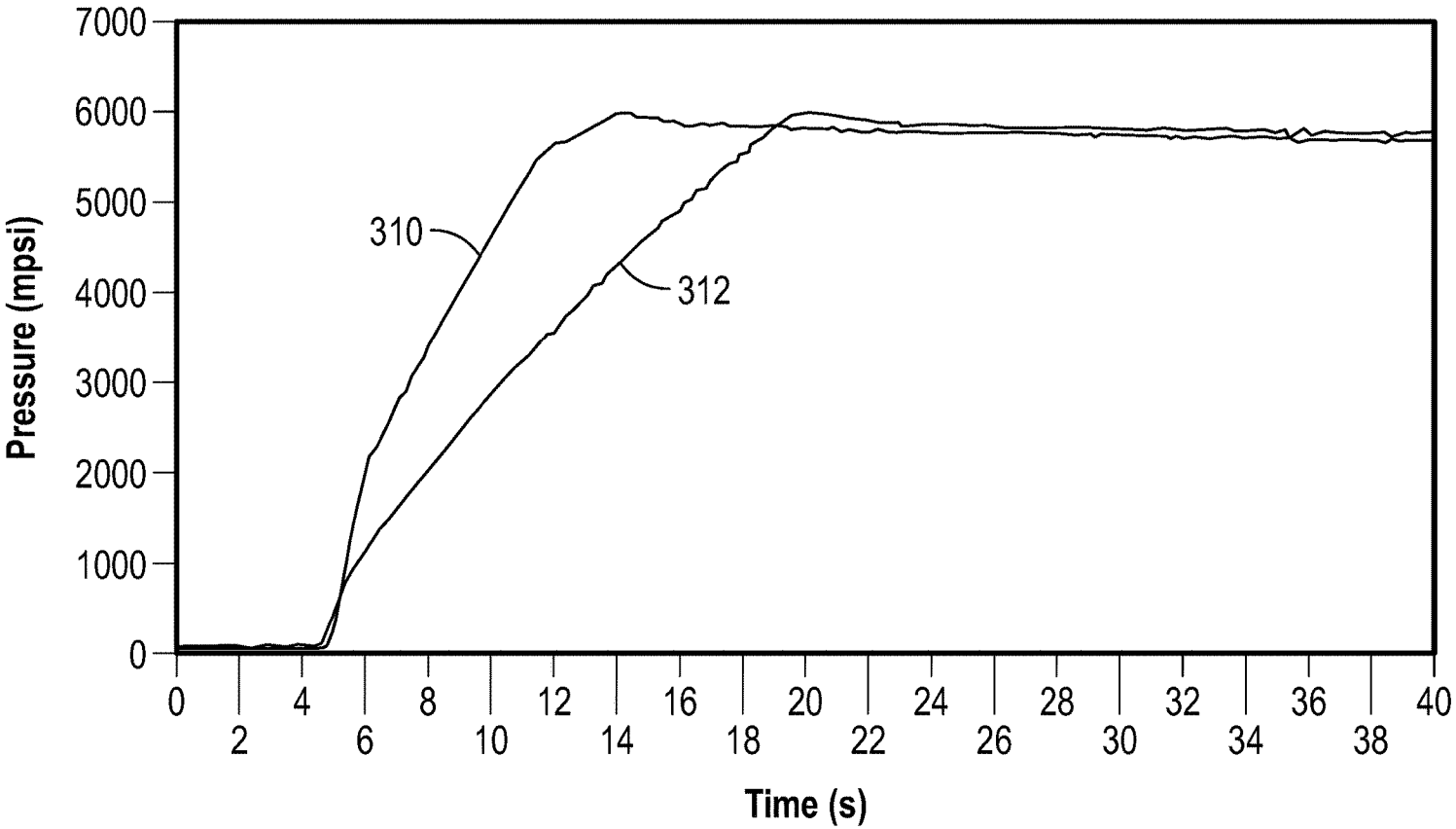
FIG. 3 is an illustration of the time used to build up working air pressure with respect to two different degradation levels of the air pressurization system according to one example.

The graphs in FIG. 3 for example illustrate the evolution of the air pressure which has been built up in the common volume of air 120 with time. One graph 310 illustrates the evolution of the built-up air pressure with time for the case that all 12 pistons 112 are working. The other graph 312 illustrates the evolution of the built-up air pressure with time for the case that only 6 pistons 112 are working. Both graphs reach a plateau when the working air pressure is reached. Thus, FIG. 3 illustrates how the time needed to pressurize the printing fluid circuit varies with the number of working pistons. It is shown that the pressurization is slower with less working pistons 112 and that therefore the time needed to reach the working air pressure is longer.

In some examples, the internal clock starts measuring the time T used to build up the working air pressure in the common volume of air 120 when the air pressurization system starts to pressurize the printing fluid circuit. In some examples, the working air pressure is a given value which is, for example, stored in a memory, and the internal clock stops measuring when the air pressure measured by pressure sensor reaches that value. In some examples, the controller determines the built-up air pressure regularly and determines that the working air pressure reaches a plateau, e.g. when the measured air pressure stays approximately constant over two or more air pressure measurements.

The controller further compares the determined time T used to build up the given air pressure to a given time t (step 622). In some examples, the given time t may be a predetermined time which is stored, e.g., in a memory. In some examples, the given time t is a theoretically calculated time (step 620). For example, the given time t is the theoretically calculated time needed to build up the given air pressure, e.g. the working air pressure, inside the common volume of air 120 inside the cartridges 116 by the air pressurization system, assuming that there is no degradation in the air pressurization system.

In some example, the given time t is theoretically calculated each time the controller compares the determined time T with the given time t. For example, the time t needed to build up the working air pressure inside an estimated volume of air 120 inside the cartridges 116 by the air pressurization system is theoretically calculated each time the controller compares the determined time T with it.

Figure 2:
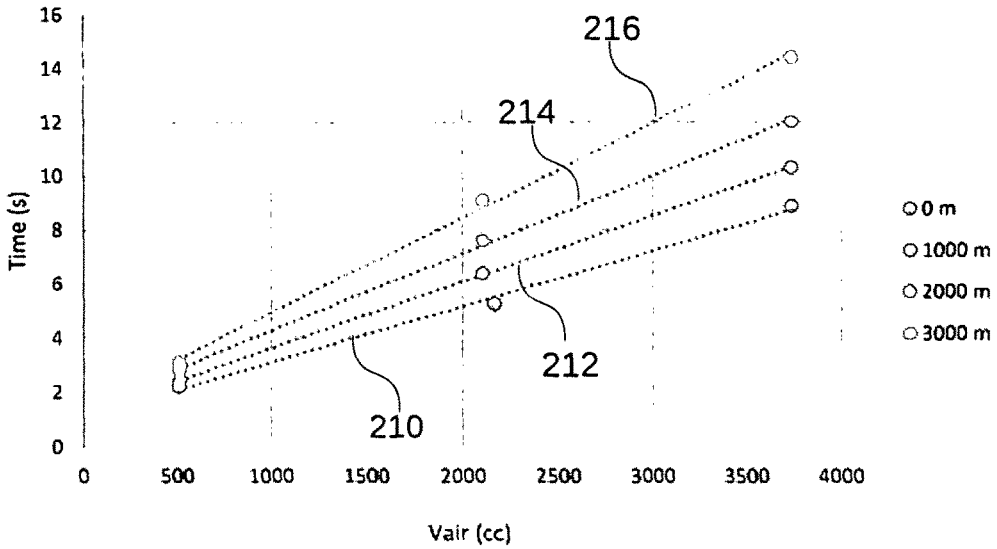
FIG. 2 is an illustration of the dependence of the time used to build up working air pressure by the air pressurization system on the common volume of air inside the printing fluid suppliers and on the altitude of the location of the printer according to one example.

FIG. 2 illustrates how the time t needed to build up working air pressure by the air pressurization system depends on the common volume of air 120 inside the cartridges. The dotted lines indicate a linear relationship between the time t and the common volume V of air inside the cartridges. In some examples, the common volume of air 120 is estimated each time the given time t is calculated (step 614). The estimated volume of air 120 inside the cartridges 116 may depend on the initial volumes of air inside the cartridges 116 and on the amount of printing fluid consumed by each cartridge. In some examples, the volume of air 120 inside the cartridges 116 is estimated as:

$$V = N \cdot V_0 + \sum_{s=1}^{N} X_s$$

with N being the number of active cartridges, e.g. N=4, $V_0$ being the initial volume of air 120 inside each active cartridge 116 and $X_s$ being the accumulated printing fluid consumption of each active cartridge.

In some examples, the given time t is calculated by linear regression, assuming a linear relationship between the time t needed to build up the given air pressure and the estimated volume of air 120 inside the cartridges. In some examples, the given time t may be calculated as:

$$t = m \cdot V + n$$

with V being the estimated volume of air 120 inside the cartridges 116 and m and n being linear regression coefficients.

In some examples, it is taken into account that the time needed to build up the working air pressure varies not only with the volume of air 120 inside the four printing fluid suppliers, but also with the altitude H of the location of the printer.

With increasing altitude of the location of the printer the surrounding air pressure is decreasing. In some examples, the surrounding air pressure may be transmitted to the printing fluid. With increasing altitude of the location of the printer, which results in decreasing surrounding air pressure, the time needed to build up the working air pressure by the air pressurization system may increase.

FIG. 2 shows this dependency exemplary for four different altitudes, namely at sea level, i.e. at 0 m (graph 210), and at 1000 m (graph 212), 2000 m (graph 214), and 3000 m (graph 216) above sea level. It can be seen that the time needed to build up working air pressure increases with increasing altitude H.

The altitude H of the location of the printer might be predetermined, for example by the manufacturer. It might also be possible that the user enters the altitude H manually when he installs the printer. However, the printer might also comprise a sensor, which measures the altitude H automatically (step 616). In some examples, the printer may use the pressure sensor to measure the ambient air pressure which indicates the altitude H of its location. In some examples, the printer may comprise a further sensor, e.g. a GPS sensor, which measures the altitude H of its location.

The time needed to build up the working air pressure in that volume may also vary depending on the degradation level of the air pressurization system. In some examples, increasing degradation of the air pressurization system may result in a slower pressurization of the at least one printing fluid supplier. The theoretical time needed to build up the given air pressure may therefore increase with increasing degradation of the air pressurization system. In some examples, the given time t is therefore calculated for a plurality of degradation levels of the air pressurization system.

It has already been pointed out with respect to FIG. 3 that the time used to reach working air pressure also depends on the number of working pistons, i.e. on the degradation level of the air pressurization system. In some examples, the given time t is therefore theoretically calculated for different numbers of working pistons, i.e. for a plurality of degradation levels. For example, the time t is calculated for each possible number of working pistons 112 ranging from 12 (i.e. all pistons) down to 1.

Figure 4:
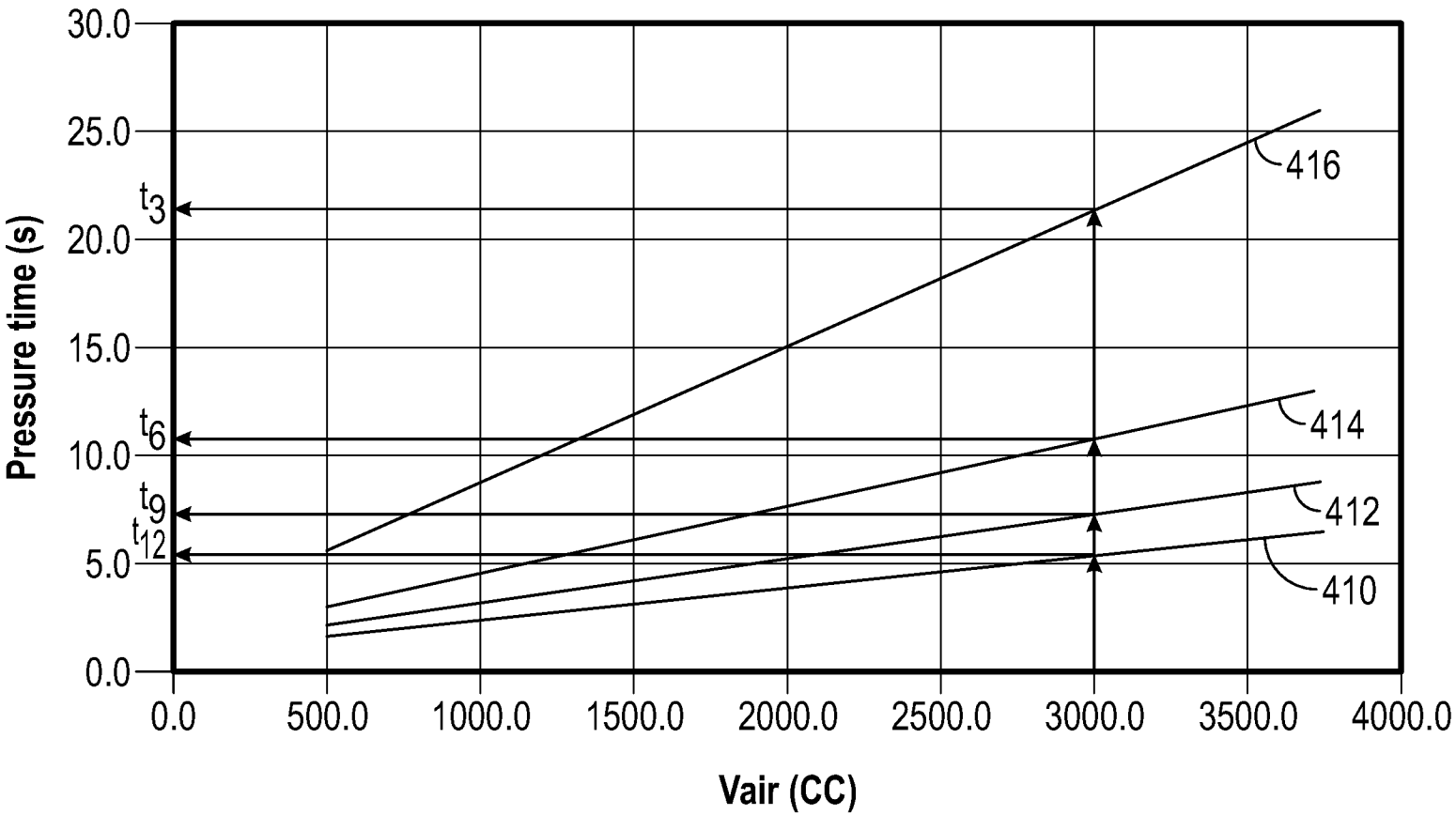
FIG. 4 is an illustration of the dependence of the theoretical time needed to build up a given air pressure on the common volume of air inside the printing fluid suppliers and on the degradation level of the air pressurization system according to one example.

FIG. 4 again shows the dependency of the theoretical time t needed to build up working air pressure on the common volume of air 120 inside the cartridges. In some examples, a linear regression model for this dependency is assumed. FIG. 4 further shows how the theoretical time varies with varying number of working pistons, i.e. with varying degradation levels. For example, the theoretical time t has been calculated and plotted for a total number of 12 (graph 410), 9 (graph 412), 6 (graph 414) and 3 (graph 416) working pistons, i.e. for four different degradation levels of the air pressurization system.

Assuming that the common volume of air 120 to be pressurized is 3000 cubic centimeter, the four different theoretical times $t_{12}$, $t_9$, $t_6$, and $t_3$, each calculated for a different number of working pistons, are indicated. Note that the theoretical time needed to build up working air pressure increases with decreasing number of working pistons.

In some examples, the given time t, i.e. the time needed to build up working air pressure in an estimated volume of air 120 inside the cartridges, is calculated for a plurality of degradation levels l (step 620). In some examples, the given time t is calculated by linear regression for the plurality of degradation levels as:

$$t_i = m_i \cdot V + n_i$$

where i is the degradation level, e.g. the number of working pistons, and $m_i$ and $n_i$ are linear regression coefficients. In some examples, the linear regression coefficients $m_i$ and $n_i$ are calculated as (step 618):

$$m_i = A \cdot i^B$$

and $$n_i = C \cdot i^D$$

with $$A = a_1 \cdot H + b_1$$

$$B = c_1 \cdot H^3 + d_1 \cdot H^2 + e_1 \cdot H + f_1$$

and $$C = a_2 \cdot H + b_2$$

$$D = c_2 \cdot H^3 + d_2 \cdot H^2 + e_2 \cdot H + f_2$$

with $a_1$, $b_1$, $c_1$, $d_1$, $e_1$, $f_1$, a2, b2, c2, d2, e2, and $f_2$ being coefficient characteristics of the air pressurization system and H being the altitude of the location of the printer.

The determined time T which has actually been used to reach working air pressure is then compared to these theoretically calculated times $t_i$, where i indicates the number of working pistons. In some examples, the differences $g_i$ between the theoretical times $t_i$ and the determined time T are calculated.

Figure 5:
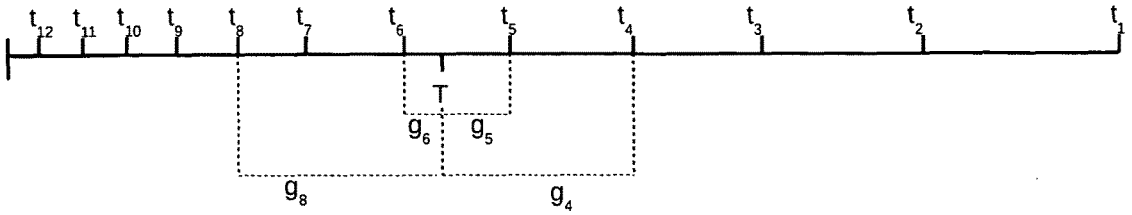
FIG. 5 is an illustration of the determination of the degradation level of the air pressurization system for which the difference between the given time t and the determined time T is minimal according to one example.

FIG. 5 shows a timeline in which the theoretical times $t_i$ needed to build up working air pressure for any number of working pistons 112 from 12 (all) down to 1 and the determined time T which has actually been used by the air pressurization system to build up working air pressure are indicated. Some exemplary differences $g_i$ between the theoretical times $t_i$ and the determined time T are also indicated. Note that the determined time T does not correspond exactly to one of the calculated theoretical times.

The degradation of the air pressurization system is then determined by determining the minimum of the differences $g_i$, i.e. the calculated theoretical time $t_i$ which differs least from the determined time T and assuming that the corresponding number i for which $g_i$ is minimal is the number of working pistons 112 in the air pressurization system. Accordingly, in the example shown in FIG. 5, the number of working pistons 112 is 6. That is, it can be concluded that half of the pistons 112 of the air pressurization system has already failed.

When the degradation level of the air pressurization system is determined, the failure of the air pumps 110 could be anticipated. For example, it could be decided to proceed to replace some components, such as defective pistons, when the degradation level exceeds a certain limit before printing problems occur. These problems, resulting from a wrong performance of the air pressurization system, could thus be avoided.

In some examples, there may be no risk for the printer if one or some of the pistons 112 of the air pumps 110 have failed. However, when the number of failed pistons 112 reaches a certain level, the performance of the printer may be too altered and printing problems may occur when the printer is continued to be operated. That is, in some examples the printer may still be operable as long as the degradation level of the air pressurization system is low. However, when the degradation level reaches a threshold value, the printer may not operate correctly and printing problems may occur.

In some examples, it may be decided to replace components of the printer when the degradation level exceeds a threshold value. That threshold value could, e.g., depend on the previous evolution of the degradation. Care should be taken to give enough margin in time to effectively proceed with the replacement before the failure occurs. On the other hand, the possibility of false alarms resulting in unnecessary replacements should be minimized.

In some examples, the information on the degradation level may allow to anticipate the time until printing problems resulting from an incorrect performance of the air pressurization system may occur. In some examples, the degradation level may be evaluated regularly. In particular, the degradation level may be evaluated periodically. In some examples, the evolution of the degradation level with time may be evaluated. This may allow a better anticipation of a printing failure and help, for example, to replace components before problems occur, thereby avoiding printing problems.

If this degradation level exceeds a specific level, it can be decided to proceed to replace the components. Consequently, the information retrieved this way allows the user or the support to anticipate a failure of the air pressurization system.

This method further allows to determine the degradation level of the air pressurization system of each of a plurality of clients at individual levels. This information allows to predict the remaining useful lifetime, i.e. the time until failure occurs, and to minimize the problems that the degradation of some components could trigger.

The degradation of the air pressurization system may be determined depending on a comparison of the air pressures determined at the first and at the second time with respect to a comparison of the first time and the second time.

In some examples, the regular evaluation of the degradation level may help to minimize the possibility of false warnings which may result in unnecessary component replacement. In some examples, the warning signal may alert the user to replace a component before printing problems occur. In some examples, there may be more than one warning signal. These warning signals may be different, depending, for example, on the degree of degradation. For example, there might be a first warning signal to indicate that a component should be replaced within a sufficiently long time period or within a sufficiently large number of pages to be printed. A second warning signal might indicate that the component should be replaced within a significantly shorter time period or that a significantly smaller number of pages could still be printed. A third warning signal might indicate that the user should not continue to use the printer before replacing the component. In some examples, the warning signal may be any of an acoustic signal, an optical signal or a combination thereof. In some examples, the signal is output directly at the printer. In some examples, the warning signal may be output at another device, such as a computer, to which the printer may be connected. In some examples, the warning signal may be transmitted as a communication to a communication device.

The invention claimed is:

1. A printer comprising a printing fluid circuit having at least one printing fluid supplier;

an air pressurization system to build up air pressure inside the at least one printing fluid supplier, wherein the air pressurization system is fluidly connected to the at least one printing fluid supplier; and a controller to:

determine a time T used to build up a given air pressure inside the at least one printing fluid supplier by the air pressurization system, compare the determined time T to a plurality of given times corresponding to a plurality of degradation levels of the air pressurization system, and determine a degradation of the air pressurization system based on the comparing of the determined time T to the plurality of given times, the determined degradation being a selected degradation level of the plurality of degradation levels.

2. The printer according to claim 1, wherein the controller is further to calculate each given time of the plurality of given times as a theoretical time needed to build up the given air pressure in an estimated volume of air inside the at least one printing fluid supplier by the air pressurization system.

3. The printer according to claim 2, wherein the controller is further to estimate the estimated volume of air inside the at least one printing fluid supplier depending on a number of active printing fluid suppliers, an initial volume of air inside a new printing fluid supplier, and an accumulated consumption of each active printing fluid supplier.

4. The printer according to claim 2, wherein the controller is further to calculate each given time of the plurality of given times by linear regression, assuming a linear relationship between the theoretical time needed to build up the given air pressure in the estimated volume of air inside the at least one printing fluid supplier by the air pressurization system and the estimated volume of air inside the at least one printing fluid supplier.

5. The printer according to claim 2, wherein the controller is further to calculate each given time of the plurality of given times depending on an altitude of a location of the printer.

6. The printer according to claim 1, wherein the controller is to:

calculate the plurality of given times for the corresponding plurality of degradation levels of the air pressurization system, and determine the selected degradation level of the air pressurization system for which a difference between the given time corresponding to the selected degradation level and the determined time T is minimal.

7. The printer of claim 6, wherein the controller is to compare the determined time T to the plurality of degradation levels by:

calculating a respective difference between the determined time T and each respective given time of the plurality of given times, comparing the respective differences, identifying the difference that is minimal based on comparing the respective differences.

8. The printer according to claim 1, wherein the air pressurization system comprises at least one air pump, the at least one air pump comprises a plurality of pistons, and the controller is further to determine the selected degradation level of the air pressurization system based on a number of defective pistons in the air pressurization system.

9. The printer according to claim 1, wherein the plurality of degradation levels correspond to respective different numbers of defective pistons, and the selected degradation level corresponds to a number of defective pistons selected from among the different numbers of defective pistons.

10. A method of determining a degradation of an air pressurization system in a printer comprising a printing fluid circuit having at least one printing fluid supplier, and an air pressurization system to build up air pressure inside the at least one printing fluid supplier, wherein the air pressurization system is fluidly connected to the at least one printing fluid supplier, wherein the method comprises:

determining the air pressure which has been built up in the at least one printing fluid supplier by the air pressurization system;

determining a time T used to build up a given air pressure inside the at least one printing fluid supplier by the air pressurization system;

comparing the determined time T with a plurality of given times corresponding to a plurality of degradation levels of the air pressurization system; and determining a degradation of the air pressurization system depending on a result of the comparison of the determined time T to the plurality of given times, the determined degradation being a selected degradation level of the plurality of degradation levels.

11. The method according to claim 10, wherein each given time of the plurality of given times is calculated as a theoretical time needed to build up the given air pressure in an estimated volume of air inside the at least one printing fluid supplier by the air pressurization system.

12. The method according to claim 11, wherein the estimated volume of air inside the at least one printing fluid supplier is estimated using a number of active printing fluid suppliers, an initial volume of air inside a new printing fluid supplier, and an accumulated consumption of each active printing fluid supplier.

13. The method according to claim 11, wherein each given time of the plurality of given times is calculated by linear regression, assuming a linear relationship between the time needed to build up the given air pressure in the estimated volume of air inside the at least one printing fluid supplier by the air pressurization system and the estimated volume of air inside the at least one printing fluid supplier.

14. The method according to claim 11, further comprising calculating the plurality of given times for the corresponding plurality of degradation levels of the air pressurization system, and determining the selected degradation level of the air pressurization system for which a difference between the given time corresponding to the selected degradation level and the determined time T is minimal.

15. The method according to claim 14, wherein the air pressurization system comprises at least one air pump, the at least one air pump comprises a plurality of pistons, and the selected degradation level of the air pressurization system is determined based on a number of defective pistons in the air pressurization system.

16. The method according to claim 14, wherein the comparison of the determined time T to the plurality of given times comprises:

calculating a respective difference between the determined time T and each respective given time of the plurality of given times, comparing the respective differences, identifying the difference that is minimal based on comparing the respective differences.

17. A non-transitory computer program product for determining a degradation of an air pressurization system in a printer comprising a printing fluid circuit having at least one printing fluid supplier, and an air pressurization system to build up air pressure inside the at least one printing fluid supplier, wherein the air pressurization system is fluidly connected to the at least one printing fluid supplier, said computer program product comprising program code, when executed by a computer, to:

determine the air pressure which has been built up in the at least one printing fluid supplier by the air pressurization system, determine a time T used to build up a given air pressure inside the at least one printing fluid supplier by the air pressurization system, compare the determined time T with a plurality of given times corresponding to a plurality of degradation levels of the air pressurization system, and determine a degradation of the air pressurization system depending on a result of the comparison of the determined time T to the plurality of given times, the determined degradation being a selected degradation level of the plurality of degradation levels.

18. The non-transitory computer program product according to claim 17, wherein the comparison of the determined time T to the plurality of given times comprises:

calculating a respective difference between the determined time T and each respective given time of the plurality of given times, comparing the respective differences, identifying a difference that is minimal from among the respective differences, wherein the selected degradation level corresponds to a given time of the plurality of given times that is associated with the difference that is minimal.

19. The non-transitory computer program product according to claim 18, wherein the plurality of degradation levels correspond to respective different numbers of defective pistons, and the selected degradation level corresponds to a number of defective pistons selected from among the different numbers of defective pistons of at least one air pump of the air pressurization system.

* * * * *